US010638910B2

(12) United States Patent
Feddema

(10) Patent No.: US 10,638,910 B2
(45) Date of Patent: May 5, 2020

(54) METHOD OF VARIABLE FILTRATION IN A DISHWASHER

(71) Applicant: Whirlpool Corporation, Benton Harbor, MI (US)

(72) Inventor: Mark S. Feddema, Kalamazoo, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1295 days.

(21) Appl. No.: 13/923,437

(22) Filed: Jun. 21, 2013

(65) Prior Publication Data

US 2014/0373876 A1 Dec. 25, 2014

(51) Int. Cl.
*A47L 15/42* (2006.01)

(52) U.S. Cl.
CPC ..... *A47L 15/4202* (2013.01); *A47L 15/4221* (2013.01); *A47L 2401/03* (2013.01); *A47L 2401/10* (2013.01); *A47L 2401/12* (2013.01); *A47L 2401/20* (2013.01); *A47L 2501/03* (2013.01)

(58) Field of Classification Search
CPC ..... A47L 15/4202; A47L 15/4221; A47L 2401/03; A47L 2401/10; A47L 2401/12; A47L 2401/20; A47L 2501/03
USPC ..... 134/10, 25.2
See application file for complete search history.

(56) References Cited

U.S. PATENT DOCUMENTS 7,040,490 B2 5/2006 Jerg
7,047,986 B2 * 5/2006 Ertle ..... A47L 15/4221 134/176
7,445,013 B2 11/2008 Vanderroest et al.
7,523,758 B2 4/2009 Vanderroest et al.
7,886,752 B2 2/2011 Jerg
2005/0011546 A1 1/2005 Ertle et al.
2005/0263174 A1 * 12/2005 Yoon ..... A47L 15/4219 134/104.1
2006/0237049 A1 * 10/2006 Weaver ..... A47L 15/4204 134/56 D
2006/0237052 A1 * 10/2006 Picardat ..... A47L 15/0047 134/56 D
2011/0056527 A1 3/2011 Classen et al.
2011/0088733 A1 4/2011 Busing et al.
2012/0097200 A1 * 4/2012 Fountain ..... A47L 15/22 134/56 D
2012/0318296 A1 * 12/2012 Fountain ..... A47L 15/4202 134/10

(Continued)

FOREIGN PATENT DOCUMENTS

WO WO 2009077280 A1 * 6/2009 ..... A47L 15/4202
WO 2012114245 A1 8/2012

OTHER PUBLICATIONS

Machine translation of WO2009/077280A1 dated Jun. 2009.*

*Primary Examiner* — Douglas Lee
(74) *Attorney, Agent, or Firm* — McGarry Bair PC

(57) ABSTRACT

A dishwasher with a tub at least partially defining a treating chamber, a spraying system for spraying liquid into the treating chamber, and a recirculation system for recirculating liquid sprayed in the treating chamber to the spraying system with a variable filtration system. Method of operating includes recirculating a liquid, supplying a first portion of the liquid through the spraying system, supplying a second portion of the liquid through the filter, and varying the amount of the second portion.

1 Claim, 8 Drawing Sheets

(56) References Cited

U.S. PATENT DOCUMENTS

2013/0000762 A1 1/2013 Buddharaju et al.

* cited by examiner

METHOD OF VARIABLE FILTRATION IN A DISHWASHER

BACKGROUND OF THE INVENTION

Contemporary dishwashers for use in a typical household include a tub defining a treating chamber in which dishes are placed for cleaning during an automatic cycle of operation, such as a wash cycle. Dishwashers include spray systems having one or more sprayers which are supplied with liquid by supply conduits. Wash liquid is recirculated through the treating chamber by a wash pump which fluidly couples the treating chamber to the supply conduits to recirculate liquid in the treating chamber. A filter can be located in the recirculation path to filter or partially filter the wash liquid before it is circulated back to the treating chamber.

BRIEF DESCRIPTION OF THE INVENTION

In one aspect, the invention relates to a method of operating a dishwasher having a tub at least partially defining a treating chamber, a spraying system for spraying liquid into the treating chamber, a recirculation system for recirculating liquid sprayed in the treating chamber to the spraying system, and a filter for filtering the recirculated liquid. The method can include recirculating a liquid through the treating chamber with the recirculation system, supplying a first portion of the liquid through the spraying system while the liquid is being recirculated, supplying a second portion of the liquid through the filter while the liquid is being recirculated, and varying the amount of the second portion of the liquid depending on at least one of a cycle parameter and a treatment condition parameter.

DESCRIPTION OF EMBODIMENTS OF THE INVENTION

The invention is generally directed toward the filtration of wash liquid in a dishwasher. The particular approach of the invention is to provide a variable filtration system that permits a varying amount of wash liquid to be filtered during a cycle of operation in a dishwasher.

Figure 1:
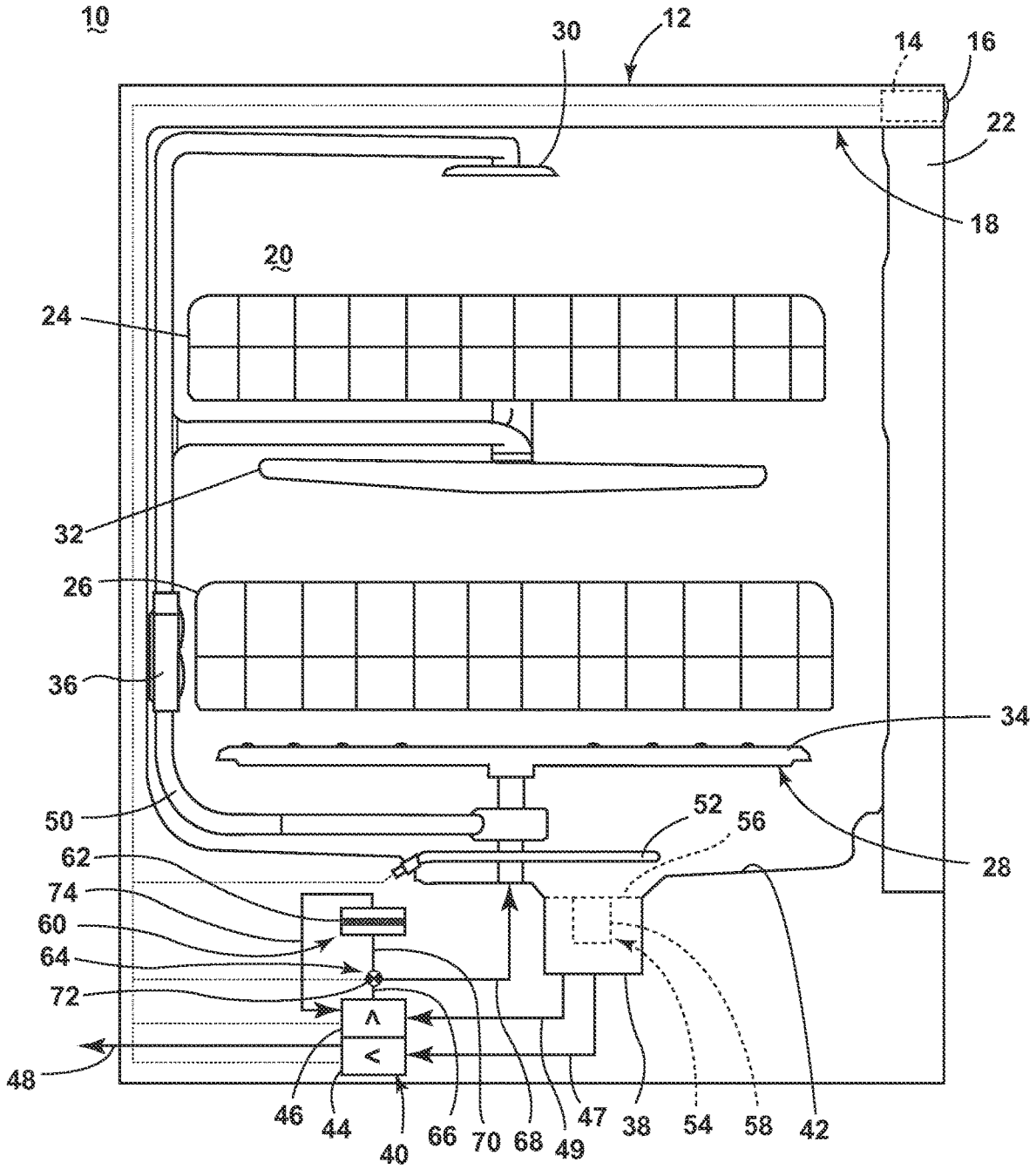
FIG. 1 is a schematic, side view of a dishwasher according to a first embodiment of the invention.

FIG. 1 is a schematic, side view of a dishwasher 10 according to one embodiment of the invention. In FIG. 1, the dishwasher 10 includes a chassis 12 defining an interior. Depending on whether the dishwasher 10 is a stand-alone or built-in dishwasher, the chassis 12 may be a frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A controller 14 may be located within the chassis 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

A tub 18 is located within the interior of the chassis 12 and at least partially defines a treating chamber 20 with an access opening in the form of an open face. A cover, illustrated as a door 22, may be hingedly mounted to the chassis 12 and may move between an opened position, wherein the user may access the treating chamber 20, and a closed position, as shown in FIG. 1, wherein the door 22 covers or closes the open face of the treating chamber 20.

Dish holders in the form of upper and lower racks 24, 26 are located within the treating chamber 20 and receive dishes for being treated. The racks 24, 26 are mounted for slidable movement in and out of the treating chamber 20 for ease of loading and unloading. As used in this description, the term "dish(es)" is intended to be generic to any item, single or plural, that may be treated in the dishwasher 10, including, without limitation; dishes, plates, pots, bowls, pans, glassware, silverware, and other utensils. While not shown, additional dish holders, such as a silverware basket on the interior of the door 22 or a third level rack above the upper rack 24 may also be provided.

A spraying system 28 may be provided for spraying liquid into the treating chamber 20 and is illustrated in the form of an upper sprayer 30, a mid-level sprayer 32, a lower rotatable spray arm 34, and a spray manifold 36. The upper sprayer 30 may be located above the upper rack 24 and is illustrated as a fixed spray nozzle that sprays liquid downwardly within the treating chamber 20. Mid-level rotatable sprayer 32 and lower rotatable spray arm 34 are located, respectively, beneath upper rack 24 and lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18. Suitable spray manifolds are set forth in detail in U.S. Pat. No. 7,445,013, filed Jun. 17, 2003, and titled "Multiple Wash Zone Dishwasher," and U.S. Pat. No. 7,523,758, filed Dec. 30, 2004, and titled "Dishwasher Having Rotating Zone Wash Sprayer," both of which are incorporated herein by reference in their entirety.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46. The drain pump 44 may draw liquid from the sump 38 via a sump drain conduit 47 and pump the liquid out of the dishwasher 10 to a household drain conduit 48. The recirculation pump 46 may draw liquid from the sump 38 via a sump recirculation conduit 49, and the liquid may be simultaneously or selectively pumped through a supply tube 50 to each of the spray assemblies 30, 32, 34, 36 for selective spraying. A heating system having a heater 52 may be located within or near the sump 38 for heating liquid contained in the sump 38.

While the pump assembly 40 is illustrated as having separate drain and recirculation pumps 44, 46 in an alternative embodiment, the pump assembly 40 may include a single pump configured to selectively supply wash liquid to either the spraying system 28 or the drain conduit 48, such as by configuring the pump to rotate in opposite directions, or by providing a suitable valve system. While not shown, a liquid supply system may include a water supply conduit coupled with a household water supply for supplying water to the sump 38.

A filtering system may be fluidly coupled with the recirculation flow path for filtering the recirculated wash liquid prior to supplying the wash liquid to the spray assemblies 30, 32, 34, 36. The sump 38 is provided with a first filter assembly 54 which includes a fine filter 56 which collects smaller soils and a coarse filter 58 which collects larger soils as wash liquid passes through the sump 38 to the pump assembly 40. The fine filter 56 can cover the inlet side of the sump 38, and the coarse filter 58 can be located at the center of the fine filter 56. A second filter assembly 60 is provided downstream of the first filter assembly 54, and can include a microfilter 62 which collects micro soils from the wash liquid that the first filter assembly 54 does not collect. In one example, the coarse filter 58 can be configured to remove soils larger than 4 to 12 mm, the fine filter 56 can be configured to remove soils larger than 700 microns and the microfilter 62 can be configured to remove soils larger than 20 microns from the wash liquid.

A liquid diverter assembly 64 can be provided downstream of the recirculation pump 46 for selectively directing liquid directly to the spraying system 28 and/or to the filter assembly 60. The diverter assembly 64 can also selectively direct liquid to both the spraying system 28 and the filter assembly 60 at the same time, and can further be configured to vary the amount of liquid diverted to the spraying system 28 and the filter assembly 60.

The diverter assembly 64 comprises a pump conduit 66 communicating with the recirculation pump 46 and defining an inlet to the diverter assembly 64, a spray conduit 68 communicating with the spraying system 28, a filter conduit 70 communicating with the filter assembly 60, and a diverter 72 for selectively directing liquid from the pump conduit 66 to the spray conduit 68 alone or in combination with the filter conduit 70. The spray conduit 68 and the filter conduit 70 define outlets from the diverter assembly 64. The filter assembly 60 further includes a return conduit 74 that returns filtered liquid to the recirculation pump 46.

During a cycle of operation, the recirculation pump 46 may pump liquid directly to the spraying system 28 for distribution onto dishes in the treating chamber 20 through the spray assemblies 30, 32, 34 and/or 36 during one or more pre-wash, wash and rinse phases of the selected cycle of operation. However, the controller 14 may control the liquid diverter assembly 64 such that a portion of the liquid pumped from the sump 38 first passes through the second filter assembly 60 before returning to the recirculation pump 46 and being supplied to the spraying system 28.

To vary the amount, the diverter assembly 64 can be configured to control the volume, volumetric flow rate, ratio, or percentage (%) of the total amount of recirculated liquid. One way in which this may be accomplished is by controlling an opening in the filter conduit 70 that fluidly couples the filter assembly 60 with the sump 38 via the recirculation pump 46.

In one configuration, the liquid diverter assembly 64 can control the amount of liquid supplied to the filter assembly 60 by varying the flow rate of liquid supplied to the filter assembly 60, and the diverter 72 can comprise a variable flow rate valve. The variable flow rate valve can have a number of discrete positions corresponding to a number of predetermined filtration levels, or could be an infinitely adjustable valve having a range of positions. For example, the valve could be infinitely adjustable between 0% filtration, in which all wash liquid is directed to the spraying system 28, and 20% filtration, in which 20% of the total amount of recirculated wash liquid is directed to the filter assembly 60 and 80% of the total amount of recirculated wash liquid is directed to the spraying system 28.

In one example, the variable flow rate valve can vary the flow rate based on the temperature of the recirculated liquid. For example, the diverter 72 can be temperature controlled, such that the diverter 72 opens and closes the opening to the filter conduit 70.

The liquid diverter assembly 64 can be configured to vary the amount of liquid supplied to each of the spraying system 28 and the filter assembly 60, such that the amount of liquid being filtered by the filter assembly 60 can be varied according to a cycle parameter and/or a treatment condition parameter. A cycle parameter is a cycle-dependent attribute that can be used to vary the amount of liquid being filtered based on the cycle of operation being executed in the dishwasher 10, some non-limiting examples of which can include a cycle type, a cycle phase, a time after the start of a cycle, a time until the end of a cycle, and a liquid temperature. A cycle type includes a series of steps taken to treat the dish load carried out in a predetermined order, some non-limiting examples of which include normal, light/china, heavy/pots and pans, and rinse only. A cycle phase is a step or subset of steps of the cycle type, some non-limiting examples of which include a pre-wash phase, a wash phase, and a rinse phase. A liquid temperature is the temperature of wash liquid being recirculated, and can be a selected to sensed liquid temperature, or based on the temperature to which the heater 52 is set. A treatment condition parameter is a load-dependent attribute that can be used to vary the amount of liquid being filtered based on the particular dish load being treated in the dishwasher 10, some non-limiting examples of which can include a soil level and a particulate size, either of which can be input by the user via the user interface 16 or sensed by the dishwasher 10.

The amount of wash liquid delivered to the filter assembly 60 can be inversely proportional to the amount of wash liquid delivered to the spraying system 28, such that as more wash liquid is delivered to the filter assembly 60 less wash liquid is delivered to the spraying system 28, and vice versa. However, the total amount of recirculated wash liquid may vary during a cycle of operation, for example if additional water is supplied to the treating chamber 20, so that relationship between the amount of wash liquid delivered to the filter assembly 60 and the spraying system 28 can likewise vary.

Figure 2:
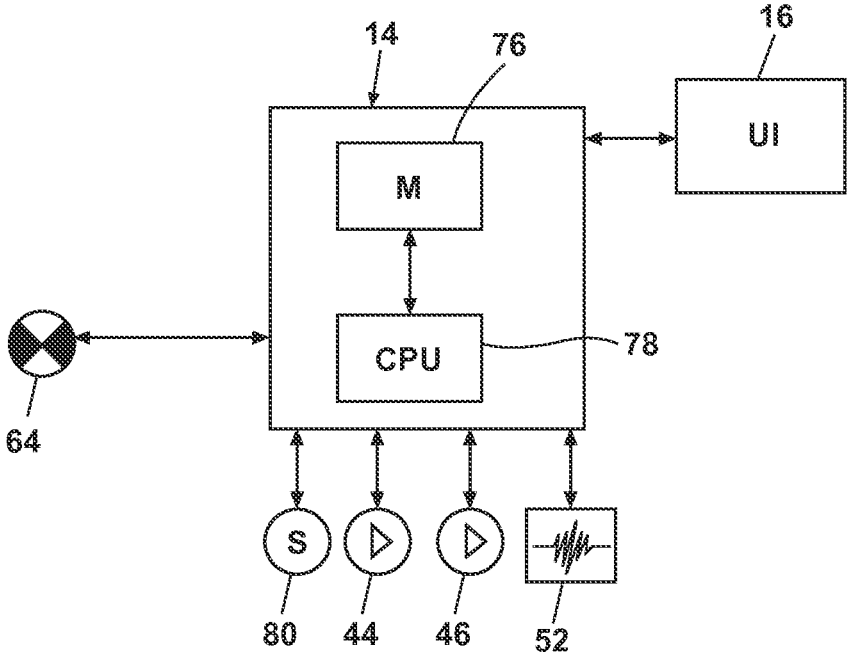
FIG. 2 is a schematic view of a controller of the dishwasher of FIG. 1.

FIG. 2 is a schematic view of the controller 14 of the dishwasher 10 of FIG. 1. As illustrated schematically in FIG. 2, the controller 14 may be coupled with the heater 52 for heating the wash liquid during a cycle of operation, the drain pump 44 for draining liquid from the treating chamber 20, the recirculation pump 46 for recirculating the wash liquid during the cycle of operation, and the liquid diverter assembly 64 for selectively directing wash liquid from the sump 38 to the spraying system 28 and/or the second filter assembly 60.

The controller 14 may be provided with a memory 76 and a central processing unit (CPU) 78. The memory 76 may be used for storing control software that may be executed by the CPU 78 in completing a cycle of operation using the dishwasher 10 and any additional software. For example, the memory 76 may store one or more pre-programmed cycles of operation that may be selected by a user and completed by the dishwasher 10. The controller 14 may also receive input from one or more sensors 80. Non-limiting examples of sensors 80 that may be communicably coupled with the controller 14 include a temperature sensor and turbidity sensor to determine the soil load associated with a selected grouping of dishes, such as the dishes associated with a particular area of the treating chamber 20.

Figure 3:
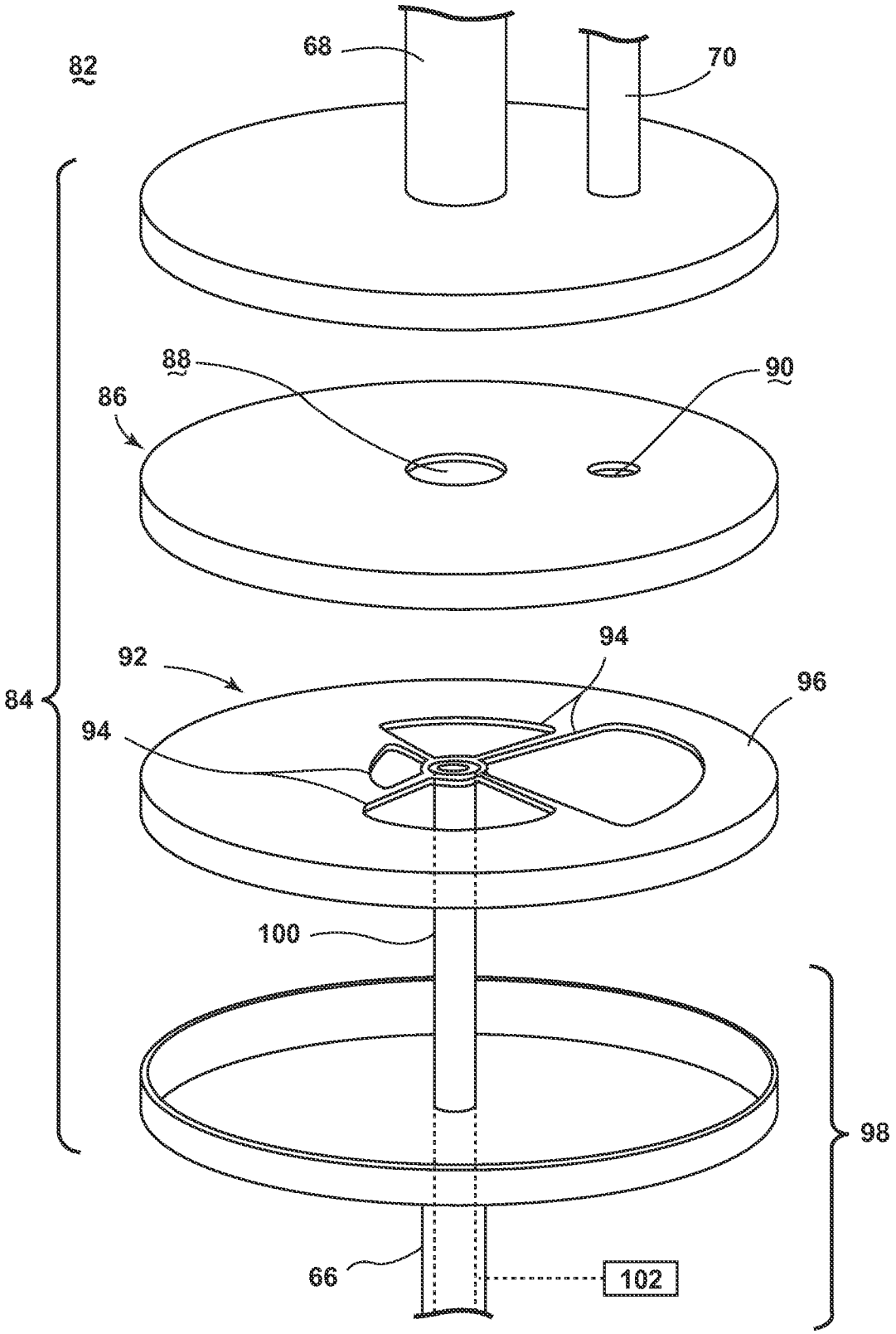
FIG. 3 is a schematic side view of a liquid diverter assembly for a dishwasher according to a second embodiment of the invention.

FIG. 3 is a schematic view of one implementation of the invention in which the liquid diverter assembly for the dishwasher 10 is a diverter valve 82. The diverter valve 82 includes a housing 84 containing a stationary disk 86 having a spray port 88 in fluid communication with the spraying system 28 and a filter port 90 in fluid communication with the filter assembly 60 and defining an inlet to the microfilter 62, and a rotatable disk 92 having multiple ports or openings 94 of varying cross-section and a solid periphery 96. The inlet side of the rotatable disk 92 can be in fluid communication with the recirculation pump 46, while the outlet side of the rotatable disk 92 can be abutted against with the stationary disk 86.

The rotatable disk 92 can be rotatably driven by a valve actuator 98, such as a drive shaft 100 coupling the rotatable disk 92 to a suitable drive motor 102. One example of a suitable drive motor 102 is a stepper motor or a wax motor. The motor 102 may be operably coupled with the controller 14 (FIGS. 1-2) for selectively moving the rotatable disk 92 to different aligned positions with the stationary disk 86 which correspond to different levels or amounts of filtration.

The openings 94 can be distributed about a rotational axis of the rotatable disk 92 as defined by the drive shaft 100. The spray port 88 on the stationary disk 86 can be centered on the rotational axis of the rotatable disk 92, so that at least one of the openings 94 is always at least partially aligned with the spray port 88, so that at least a portion of the recirculating liquid is always supplied to the spraying system 28. The filter port 90 can be offset from the rotational axis of the rotatable disk 92, so that the alignment of the filter port 90 with the openings 94 can be varied. The cross-sections of the openings 94 can vary by shape and/or size such that when each opening 94 is aligned with the filter port 90, the periphery 96 of the rotatable disk 92 can cover all, some, or none of the filter port 90. However, at the same time, each opening 94 is also aligned with the spray port 88, such that at least a portion of the spray port 88 is always uncovered.

Figure 4:
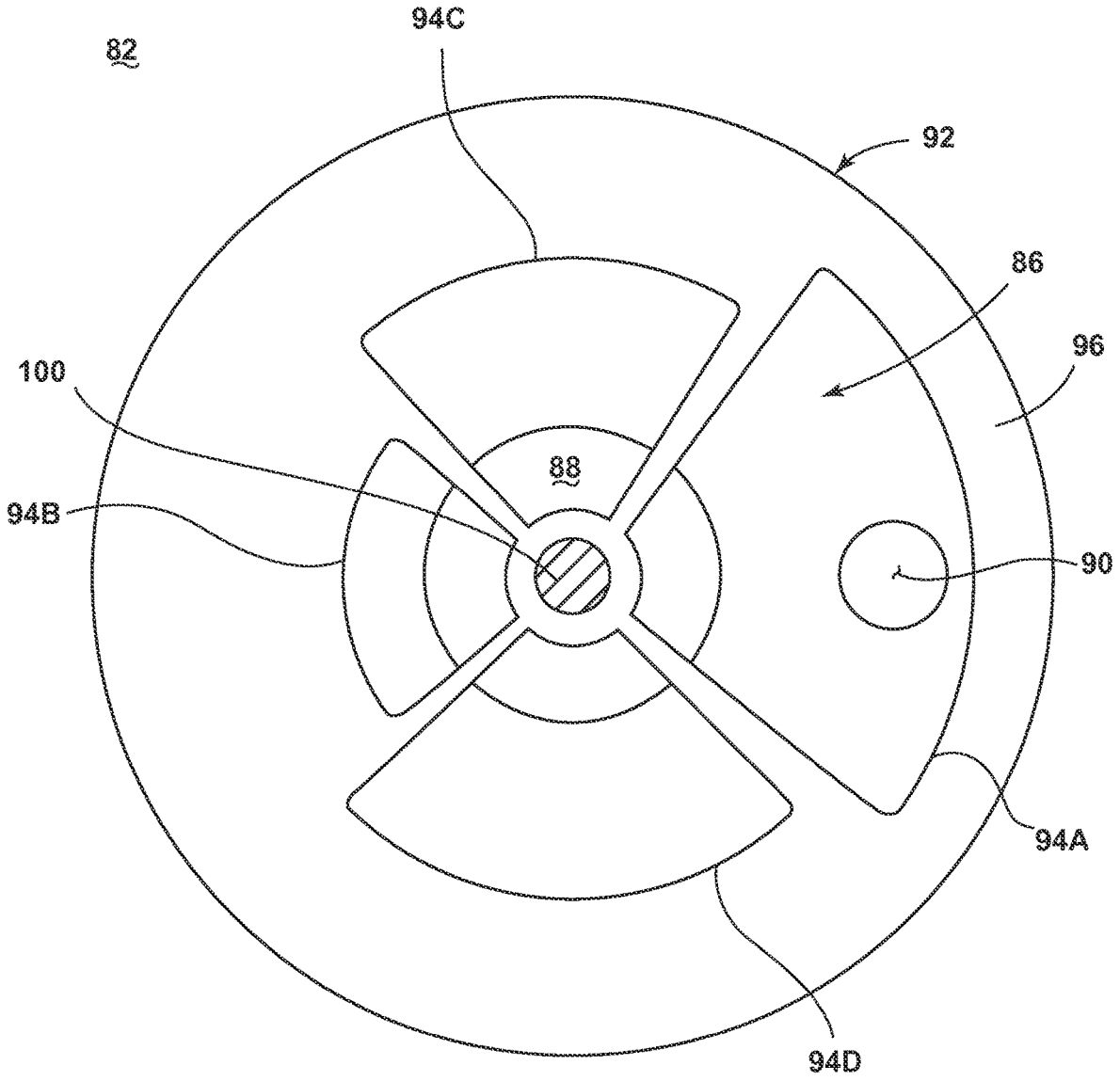
FIG. 4 is a top view of the liquid diverter assembly from FIG. 3, illustrating the liquid diverter assembly in a fully open position.
Figure 5:
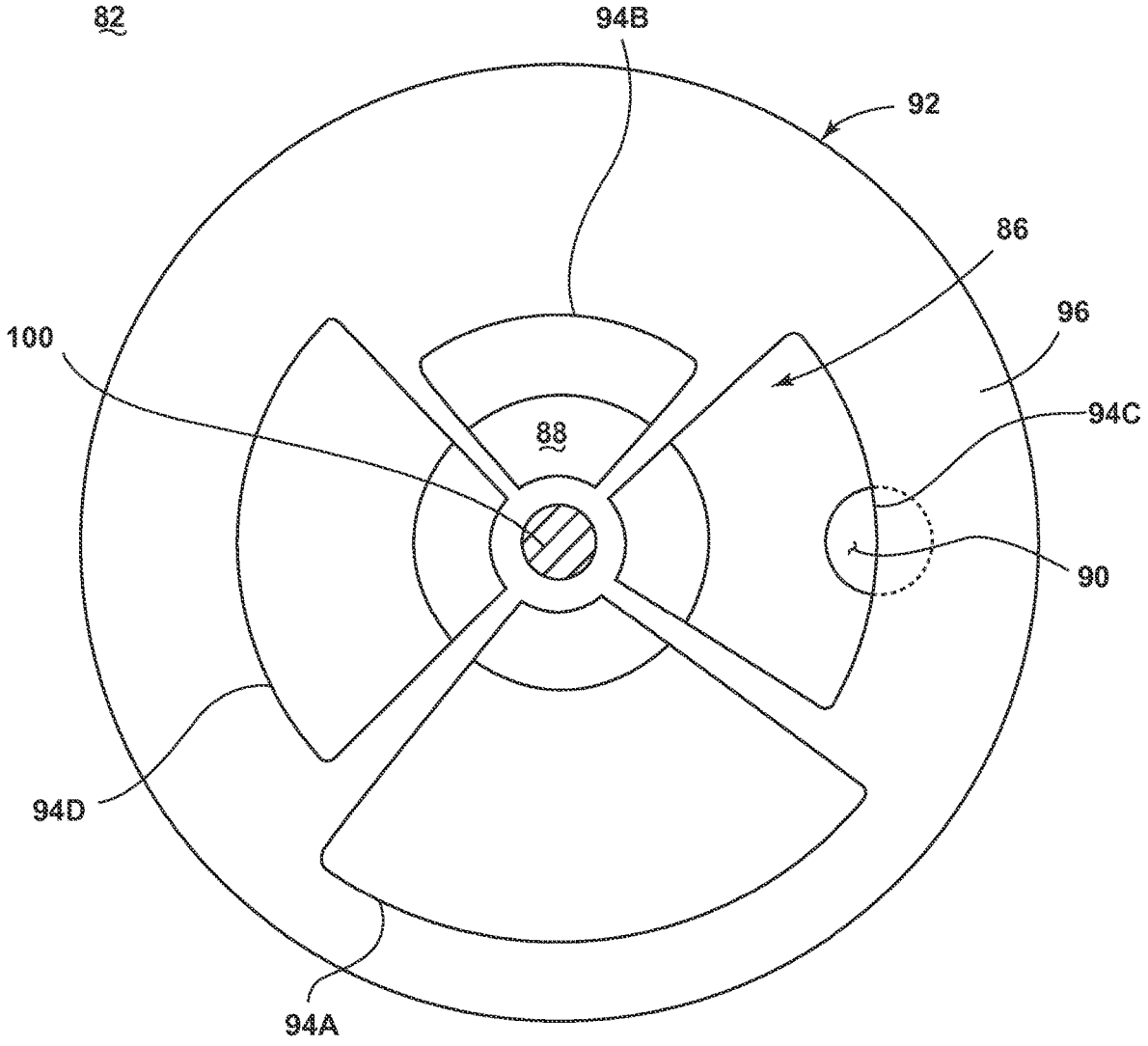
FIG. 5 is a top view of the liquid diverter assembly from FIG. 3, illustrating the liquid diverter assembly in a partially open position.
Figure 6:
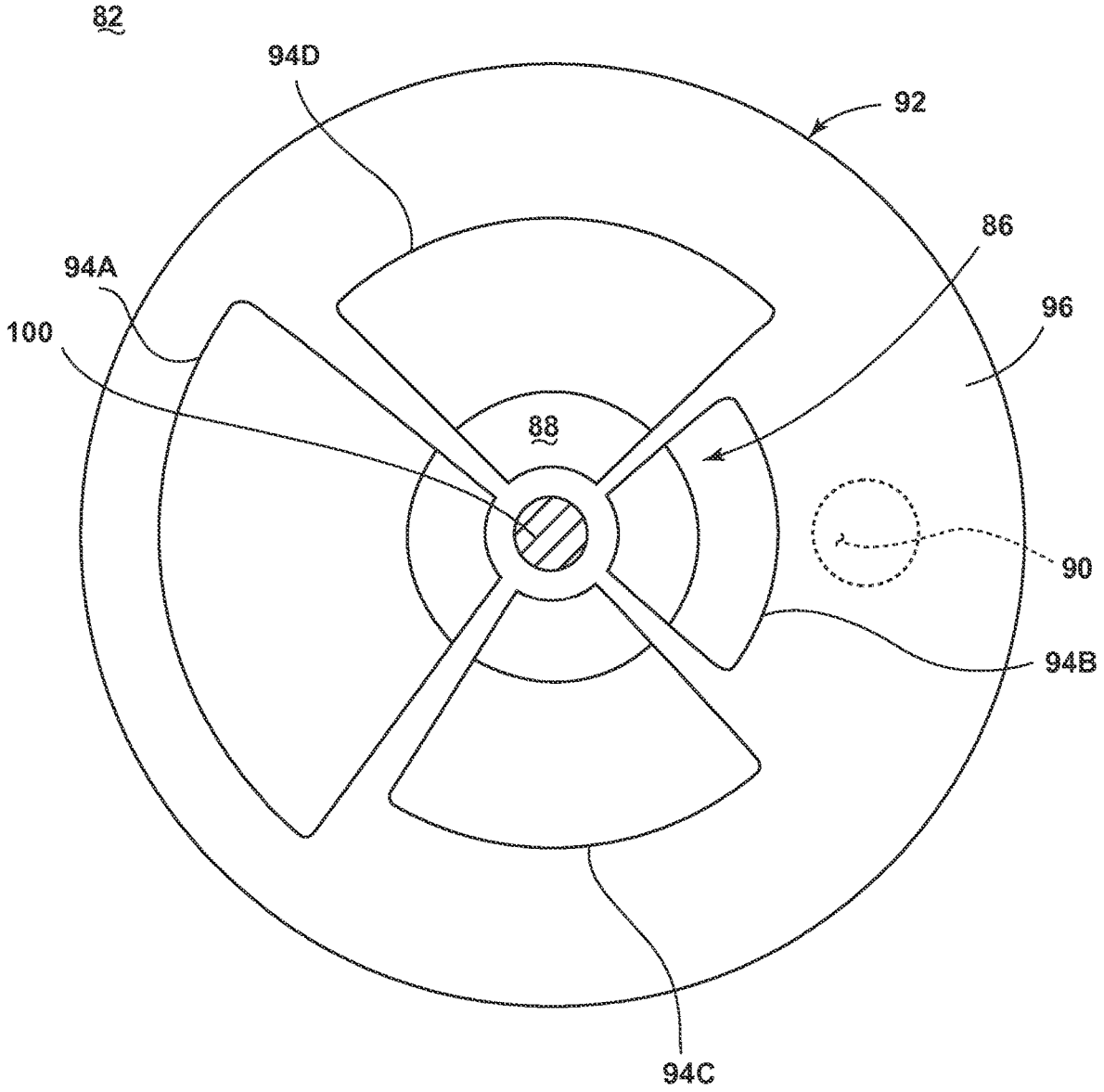
FIG. 6 is a top view of the liquid diverter assembly from FIG. 3, illustrating the liquid diverter assembly in a fully closed position.

FIGS. 4-6 are top views of the diverter valve 82 from FIG. 3, illustrating the diverter valve 82 in various positions. Referring to FIG. 4, the openings 94 in the rotatable disk 92 can have varying cross-sections, with the width of the periphery 96 varying in correspondence with the cross-sections. In the embodiment shown herein, four openings 94A-D are provided in the rotatable disk 92 and correspond to varying levels of filtration. The openings include a large opening 94A corresponding to a maximum level of filtration, a small opening 94B in opposition to the large opening 94A corresponding to a minimum level of filtration, and two medium openings 94C, 94D in between the large and small openings 94A, 94B corresponding to intermediate levels of filtration. In one example, the maximum level of filtration can equate to 20% of the total amount of recirculated wash liquid being filtered, the minimum level of filtration can equate to 0% of the total amount of recirculated wash liquid being filtered, and the intermediate level of filtration can equate to 10% of the total amount of recirculated wash liquid being filtered.

The rotatable disk 92 can rotate between multiple positions, where each position is associated with a preset ratio of water recirculation to the spraying system 28 and the filter assembly 60. FIG. 4 shows the rotatable disk 92 in a first position, in which the large opening 94A is aligned with the filter port 90. FIG. 5 shows the rotatable disk 92 in a second position, in which one of the medium openings 94C is aligned with the filter port 90. FIG. 6 shows the rotatable disk 92 in a third position, in which the small opening 94B is aligned with the filter port 90.

Figure 7:
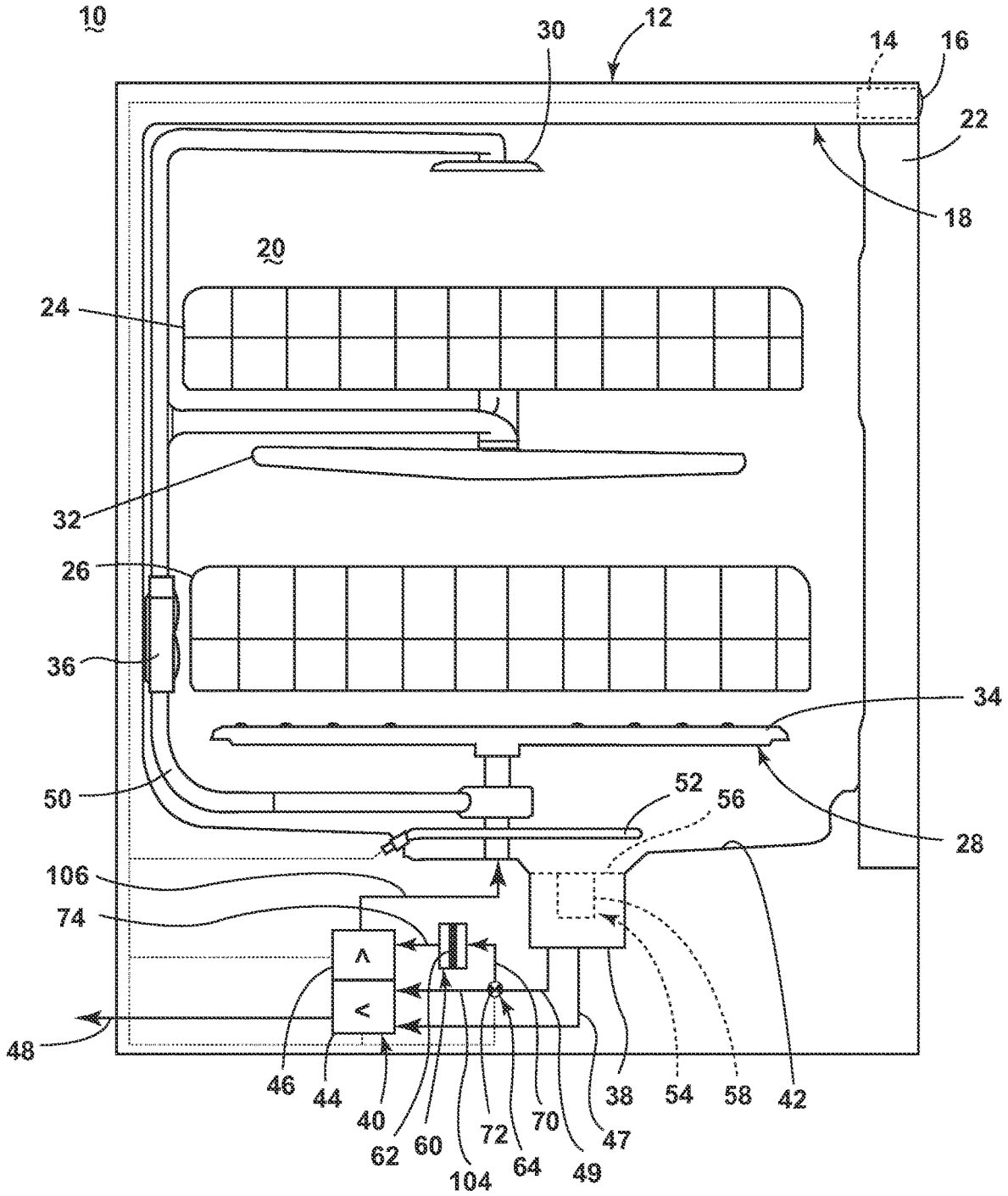
FIG. 7 is a schematic, side view of a dishwasher according to a third embodiment of the invention.

FIG. 7 is a schematic, side view of a dishwasher 10 according to a third embodiment of the invention. The dishwasher 10 can be substantially similar to the dishwasher 10 of the first embodiment, and like references numerals are used to identify like features. The third embodiment differs from the first embodiment in the location of the liquid diverter assembly 64 with respect to the recirculation pump 46 of the liquid recirculation system. In the third embodiment, the liquid diverter assembly 64 is provided downstream of the sump 38 but upstream of the recirculation pump 46 for selectively directing liquid directly to the recirculation pump 46 and/or to the filter assembly 60. In this case, the liquid diverter assembly 64 indirectly supplies liquid to the spraying system 28 via the recirculation pump 46. The sump recirculation conduit 49 communicating with the sump 38 defines the inlet to the diverter assembly 64, and the outlets from the diverter assembly 64 are defined by the filter conduit 70 communicating with the filter assembly 60 and a pump conduit 104 communicating with an inlet of the recirculation pump 46. A spray conduit 106 communicates an outlet of the recirculation pump 46 with the spraying system 28. The liquid diverter assembly 64 can have the structure shown in FIGS. 3-6, or any other structure disclosed herein for the first embodiment of the liquid diverter assembly.

Figure 8:
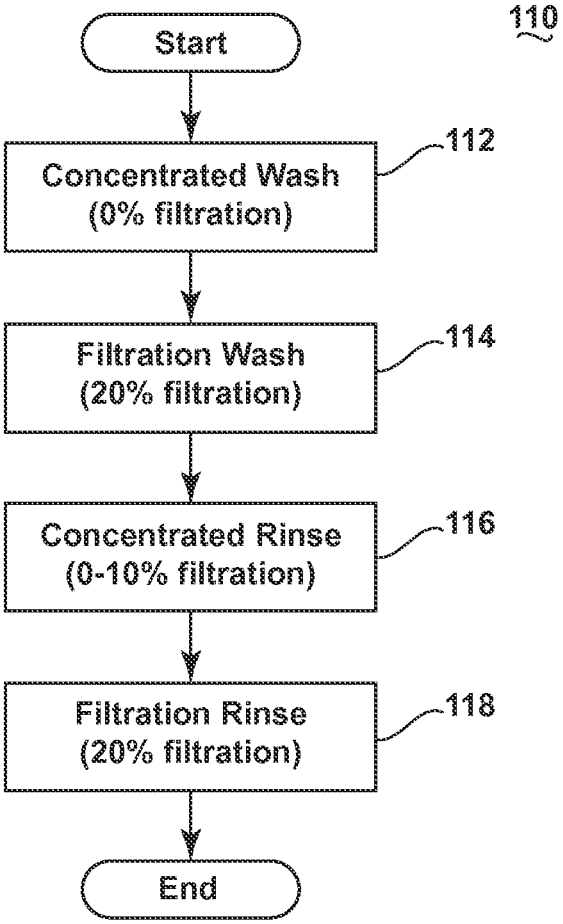
FIG. 8 is a flow chart illustrating an exemplary cycle of operation for a dishwasher in which the amount of filtration is varied.

FIG. 8 is a flow chart illustrating an exemplary cycle of operation for the dishwasher 10 in which the amount of filtration is varied. The cycle 110 may be executed by the controller 14 during a cycle of operation of any of the embodiments of the dishwasher 10 disclosed herein. The sequence of steps depicted for the cycle 110 are for illustrative purposes only, and are not meant to limit the method in any way as it is understood that the steps may proceed in a different logical order or additional or intervening steps may be included without detracting from the invention.

The cycle 110 begins with assuming that a user has loaded the dishwasher 10 with the dishes to be treated and selected a desired cycle of operation. Generally, in normal operation of the dishwasher 10, a user first selects an appropriate cycle type via the user interface 16; alternatively, the cycle type can be automatically selected by the dishwasher 10 based on a sensed condition of the dish load. Non-limiting examples of cycle types include normal, light/china, heavy/pots and pans, and rinse only. The cycle selection may occur prior to the start of the cycle 110. The cycle 110 and/or each phase of the cycle may have an associated filtration amount, which defines the amount of wash liquid being passed through the filter assembly 60. The cycle 110 also begins with assuming that wash liquid has been supplied to the dishwasher 10, and the recirculation system is operating.

The cycle 110 may begin with a concentrated wash phase 112 in which all wash liquid is delivered to the spraying system 28 and no filtration is performed by the filter assembly 60. In this phase 112, all wash liquid is concentrated on removing soil from the dishes. This phase 112 may correspond to the third position of the diverter valve 82 shown in FIG. 6, in which the small opening 94B is aligned with the filter port 90 such that the filter port 90 is completely covered by the rotatable disk 92.

The cycle 110 continues with a filtration wash phase 114 in which wash liquid is divided between the spraying system 28 and the filter assembly 60. In this phase 114, a portion of the wash liquid is filtered by the filter assembly 60, while the remaining portion of the wash liquid is delivered directly to the spraying system 28 to remove soil from the dishes. Since the wash liquid may contain a high amount of soil from the concentrated wash phase 112, this phase 114 may correspond to the first position of the diverter valve 82 shown in FIG. 4, in which the large opening 94A is aligned with the filter port 90 such that the filter port 90 is completely uncovered by the rotatable disk 92.

The cycle 110 continues with a concentrated rinse phase 116 in which wash liquid is either entirely delivered to the spraying system 28 or divided between the spraying system 28 and the filter assembly 60. The filtration amount may depend on a cycle parameter and/or a treatment condition parameter. For example, a highly soiled load may require filtration during phase 116, while a lightly soiled load may not require filtration. Depending on the required filtration amount, phase 116 may correspond to the third position of the diverter valve 82 shown in FIG. 6, in which the small opening 94B is aligned with the filter port 90 such that the filter port 90 is completely covered by the rotatable disk 92, or may correspond to the second position of the diverter valve 82 shown in FIG. 5, in which the medium opening 94C is aligned with the filter port 90 such that the filter port 90 is partially covered by the rotatable disk 92.

The cycle 110 concludes with a filtration rinse phase 118 in which wash liquid is divided between the spraying system 28 and the filter assembly 60. In this phase 118, a portion of the wash liquid is filtered by the filter assembly 60, while the remaining portion of the wash liquid is delivered directly to the spraying system 28 to remove soil from the dishes. Since the wash liquid may contain a high amount of soil from the concentrated rinse phase 116, this phase 118 may correspond to the first position of the diverter valve 82 shown in FIG. 4, in which the large opening 94A is aligned with the filter port 90 such that the filter port 90 is completely uncovered by the rotatable disk 92.

The dishwasher and methods of controlling the dishwasher disclosed herein provides improved filtration control. One advantage that may be realized in the practice of some embodiments of the described dishwasher 10 and dishwasher methods is that the amount or ratio of liquid that is filtered can be adjusted or varies during a cycle. Currently, dishwasher filtration systems filter a fixed amount of the recirculating liquid. For example, about 10% of the total amount of recirculated wash liquid may be passed through a filter before reentering the treating chamber, with 90% returning directly to the treating chamber. For a highly soiled load, the dishwasher filters the same fixed amount of the recirculating liquid as for a lightly soiled load, which may be ineffective. Also, at the end of a cycle when the majority of the soil has already been removed, the same amount of liquid is filtered, rather than focusing on washing in the treating chamber, which is inefficient. The present invention enables filtration to be varied to optimize soil removal and cleaning performance.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a dishwasher having a tub at least partially defining a treating chamber, a spraying system for spraying liquid into the treating chamber, a recirculation system for recirculating liquid sprayed in the treating chamber to the spraying system, and a filter for filtering the recirculated liquid, the method comprising:

recirculating a liquid through the treating chamber with the recirculation system;

selectively diverting, via a diverter assembly, a portion of the recirculating liquid to define both a first portion of the liquid and a second portion of the liquid;

bypassing the filter with the first portion of the liquid;

supplying the first portion of the liquid through the spraying system while the liquid is being recirculated;

supplying the second portion of the liquid through the filter while the liquid is being recirculated; and varying an amount of the second portion of the liquid that is selectively diverted via the diverter assembly depending on at least one of a cycle parameter or a treatment condition parameter during the recirculating;

wherein the diverter assembly includes a rotatable valve element with multiple openings and at least a portion of one of the openings of the multiple openings is fluidly coupled with the spraying system at all times so the supplying the first portion through the spraying system is continuous and the filtered second portion is combined with the first portion and both are supplied to the spray system or the filtered second portion is combined with the liquid being recirculated prior to entering a pump of the recirculation system;

wherein varying the amount of the second portion comprises controlling an opening in a conduit of the recirculation system that fluidly couples a sump of the dishwasher to the filter;

wherein controlling the opening in the conduit comprises varying the flow rate with the rotatable valve element; and wherein varying the flow rate comprises varying the flow rate based on the temperature of the recirculated liquid.

* * * * *